US006878204B1

(12) United States Patent
Kinnison et al.

(10) Patent No.: US 6,878,204 B1
(45) Date of Patent: Apr. 12, 2005

(54) METHODS AND APPARATUS FOR APPLYING A THERMAL CONDUCTIVE MEDIUM

(75) Inventors: Charlotte F. Kinnison, San Diego, CA (US); John F. Hayfield, San Diego, CA (US)

(73) Assignee: AMS Research Corporation, Minnetonka, MN (US)

( * ) Notice: Subject to any disclaimer, the term of this patent is extended or adjusted under 35 U.S.C. 154(b) by 0 days.

(21) Appl. No.: 09/993,397

(22) Filed: Nov. 14, 2001

(51) Int. Cl.[7] ..... B05B 13/06; B05C 5/00

(52) U.S. Cl. ..... 118/317; 118/306; 118/676; 118/DIG. 10

(58) Field of Search ..... 118/317, 318, 118/306, DIG. 10, 676

(56) References Cited

U.S. PATENT DOCUMENTS

| | | | | | |
|---|---|---|---|---|---|
| 3,977,358 | A | * | 8/1976 | Stroobants | 118/682 |
| 4,136,560 | A | * | 1/1979 | Gellos | 73/146.8 |
| 4,161,198 | A | * | 7/1979 | Sojka | 141/92 |
| 4,844,098 | A | * | 7/1989 | Mitchen | 600/578 |
| 5,038,708 | A | * | 8/1991 | Wells et al. | 118/317 |
| 5,141,774 | A | * | 8/1992 | Prittinen | 118/317 |
| 5,403,309 | A | | 4/1995 | Coleman et al. | |
| 5,910,104 | A | | 6/1999 | Dobak, III et al. | |
| 6,306,129 | B1 | | 10/2001 | Little et al. | |
| 6,451,012 | B1 | | 9/2002 | Dobak, III | |
| 6,475,212 | B1 | | 11/2002 | Dobak, III et al. | |
| 6,530,234 | B1 | | 3/2003 | Dobak, III et al. | |
| 2003/0130575 | A1 | | 7/2003 | Desai | |
| 2004/0002647 | A1 | | 1/2004 | Desai | |

* cited by examiner

*Primary Examiner*—Chris Fiorilla
*Assistant Examiner*—Yewebdar Tadesse
(74) *Attorney, Agent, or Firm*—José W. Jimenez

(57) ABSTRACT

Method and apparatus for applying a thermal conductive medium (TCM) to the inside of a disposable sheath. A uniform amount of TCM is applied in an automated manner to the conductive portion of a disposable sheath to increase conductivity. Application is by way of a rotating tip having a plurality of nozzles through which TCM is pumped under control of a timing circuit. The duration of TCM application and the rotation of the tip is carefully controlled to insure uniform application of a precise amount of TCM. TCM application is avoided at portions of the sheath where thermal conductivity is not desired and at the tip of the sheath which will be coated by TCM as a result of probe insertion into the sheath. By automating the TCM application process, TCM can be applied in precise amounts and in a uniform manner without accidentally coating areas of the sheath where TCM is not desired. In addition the process can be conducted in far less time than is required to manually apply TCM.

12 Claims, 4 Drawing Sheets

METHODS AND APPARATUS FOR APPLYING A THERMAL CONDUCTIVE MEDIUM

FIELD OF THE INVENTION

The present invention is directed to methods and apparatus for coating the inside of at least a portion of a sheath, e.g., a sheath used to cover a medical device, with a thermal conductive medium (TCM).

BACKGROUND OF THE INVENTION

Medical devices, e.g., probes, are used in a variety of applications. Such probes are frequently inserted into the human body as part of medical procedure. Probes are often relatively expensive durable devices. In many cases, absent the risk of disease transfer and/or infection, probes may be used repeatedly. Unfortunately, a probe's shape and/or construction can make it difficult to sterilize thoroughly between uses.

For purposes of avoiding infection and the problems associated with sterilizing a probe thoroughly a sterile sheath may be used to cover the portion of the probe which is inserted into the human body. After each use, the used sheath is discarded and replaced with a new sterile sheath thereby allowing reuse of the probe at a minimal cost.

In cases of medical probes where thermal conductivity is important, e.g., cryogenic probes and/or temperature sensing probes, the sheath should not interfere significantly with the transfer of heat to/from portions of the probe where thermal transfer is intended to occur.

One example of a medical probe that may use a sheath is a cryogenic probe such as the probe 100 shown in FIG. 1. The probe 100 comprises a handle 102, a hollow tubular cannula 106, and a cold tip 108. The cold tip 108 is used to absorb heat from any tissue with which it contacts thereby cooling and potentially freezing the contacted tissue. Thus, in the known probe 100, heat transfer is to occur at the tip 108. However, heat transfer is intended to be limited elsewhere to prevent the unintentionally freezing of tissue contacting the cannula 106.

A sterile sheath may be placed over the probe 100 to protect the probe from contamination, and to protect the patient from possible infection. Preferably, the sheath has a thermally conductive region that covers the cold tip 108, and a nonconductive or less conductive region corresponding to the portion of the sheath intended to surround the cannula 106.

In order to insure good thermal conductivity at points where heat transfer is desired, there should be a snug fit between the sheath and the probe. In order to enhance thermal transfer between the sheath and probe at the desired points a thermal conductive medium (TCM), e.g., thermally conductive grease, may be applied to the inside of the sheath.

Known techniques for applying TCM to the interior of a sheath involve manually applying a TCM to the conductive region, e.g., tip, of the sheath using a hand held wand brush. In the known method, the TCM is first applied to the wand brush and then the brush is inserted into the tip of the sheath transferring the TCM to the inside of the sheath's tip. This method leads to variability in the amount of TCM applied to the sheath and can lead to the problems discussed above associated with TCM lumps and excessive TCM application.

In addition to problems relating to variability in TCM application, the known TCM application procedure has the disadvantage of being time consuming to perform.

In view of the above discussion, it can be appreciated that there is a need for improved methods and apparatus for applying TCM to specific portions of a sheath. It is desirable that any new TCM application methods produce more reliable and uniform application of TCM to the intended portions of the sheath. It is also desirable that any new TCM application methods reduce the amount of time associated with performing the TCM application process.

SUMMARY OF THE INVENTION

The present invention is directed to methods and apparatus for applying a thermal conductive medium (TCM) to the inside of a sheath, e.g., a disposable cryosurgical sheath.

Generally, the goal is to achieve a uniform thin film of TCM between the thermally conductive portions of the probe and sheath when the sheath is covering the probe. Lumps and/or excessive amounts of TCM on the sheath are undesirable since they can interfere with insertion of the probe into the sheath potentially causing rupturing of the sheath during probe insertion. Lumps and/or excessive amounts of TCM can also cause air to be trapped between the tip of the probe and the sheath interfering with thermal transfer, and/or increase thermal transfer along portions of the probe, e.g., the cannula, where heat transfer is not desired.

Normally, a TCM is applied to the interior of the sheath prior to packaging. In this manner, the medical technician need only open the sterile sheath and insert the probe prior to use of the probe.

In accordance with the invention, a uniform amount of TCM may be applied in an automated manner to the conductive portion of a disposable sheath, using a TCM applicator device of the present invention, to increase conductivity at desired portions of the sheath.

An exemplary TCM application device of the invention includes a TCM pump, tubular shaft, applicator tip, control circuit and a switch. The switch may be manually operated. Alternatively, the switch may be, e.g., a contact switch, that is triggered by placing a sheath over the applicator tip and tubular shaft. In response to activation of the switch, the control circuit beings the pumping of TCM and the applicator shaft and tip are rotated as TCM flows out nozzles in the side of the applicator tip. After TCM is pumped for a fixed amount of time, the pump is stopped by the control circuit while rotation of the applicator shaft and tip is allowed to continue so that the TCM will be spread by the wiping action associated with the rotation. Rotation of the applicator shaft and TIP is stopped after a set amount of time and the sheath is removed. Optionally, the applicator's shaft and tip may be purged of TCM preparing the device for processing of the next sheath.

The control circuit may be implemented as a processor controlled by software with set times for starting/stopping the pump and motor being programmed into memory along with said control software. Alternatively the control circuit can be implemented using fixed electrical circuits with the set periods of time being determined by the electrical components selected to implement the control circuit.

In one embodiment, the applicator tip is designed with a mushroom shaped top designed to prevent application of TCM to the tip of the sheath. During insertion of the probe TCM from the sidewalls of the sheath will be transferred by the probe to the tip. Accordingly, by limiting and/or preventing application of TCM to the inside tip of the sheath, excessive amounts of TCM at the tip during use are avoided.

Since the amount of TCM applied can be precisely controlled by the time TCM is pumped, application of excessive amounts of TCM can be avoided. In addition, TCM can be applied in a much more uniform manner than can normally be achieved using the known manual TCM application technique.

Because the application process of the invention is performed in an automated manner, it has the additional advantage of normally taking less time than the known manual technique of applying TCM.

Numerous features and advantages of the present invention will be apparent in view of the detailed description set forth below.

DETAILED DESCRIPTION

The present invention is directed to methods and apparatus for applying a thermal conductive medium (TCM), e.g., conductive grease, to portions of the interior of a sheath, e.g., a sheath for a disposable cryosurgical probe. The TCM may be applied in order to increase the thermal conductivity between the disposable sheath and the probe at specific desired locations, e.g., the tip.

Figure 1:
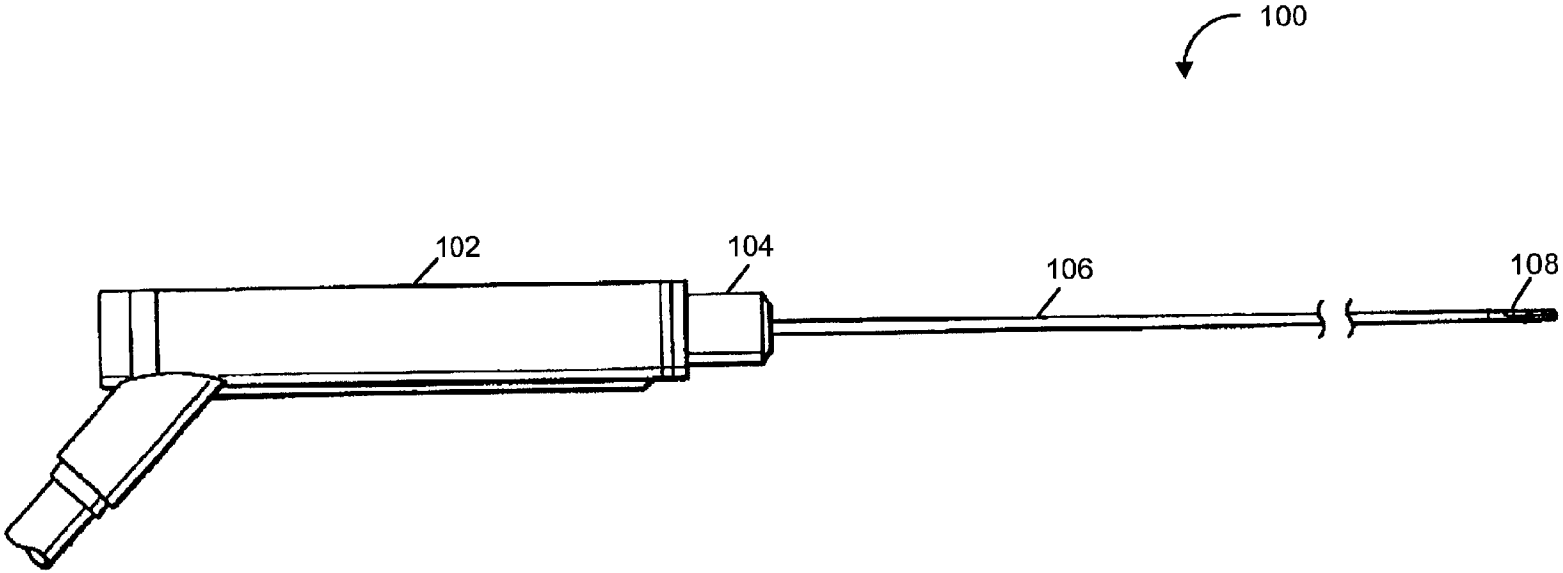
PRIOR ART Fig. 1
FIG. 1 illustrates a known cryogenic medical probe.
Figure 2:
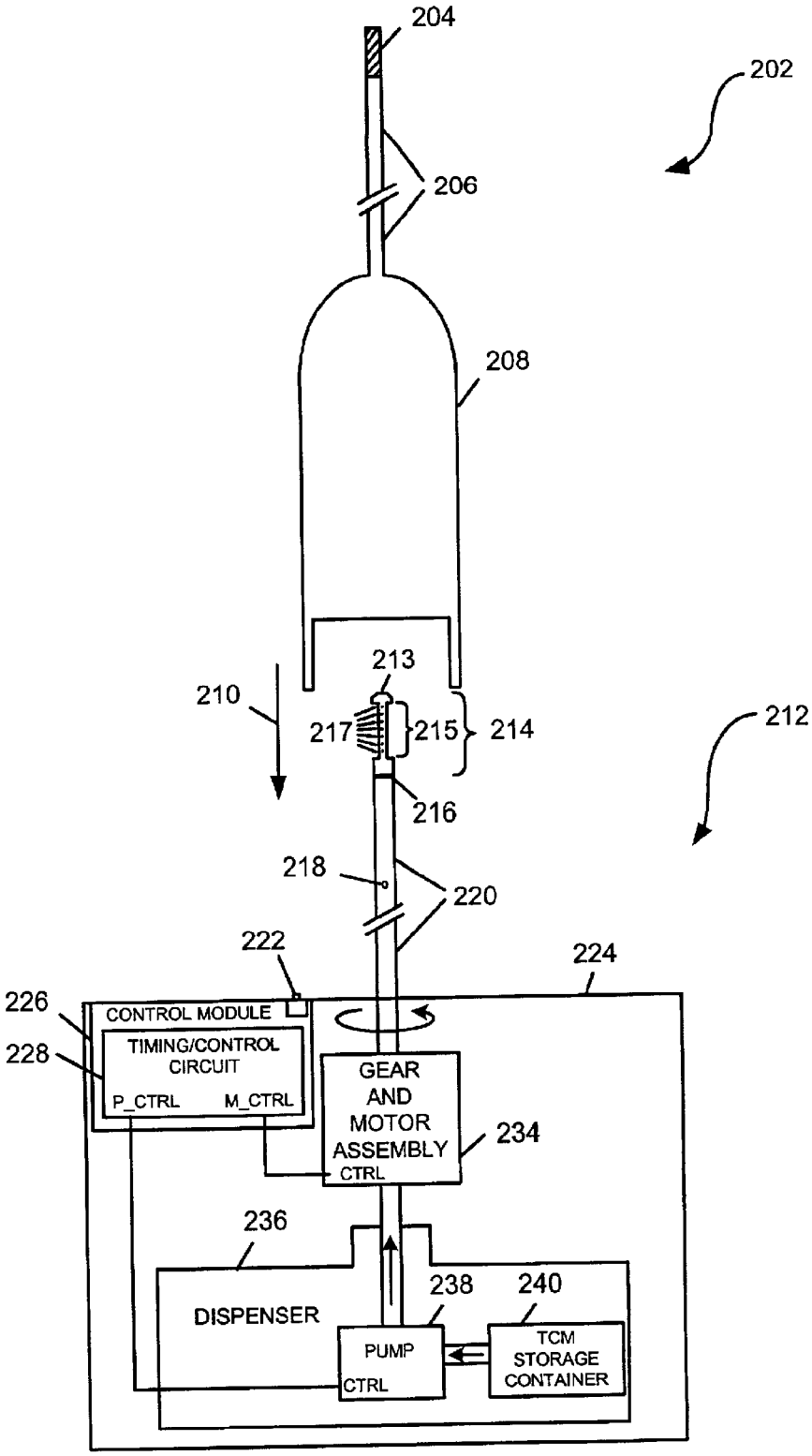
FIG. 2 is a diagram of a sheath and an exemplary TCM applicator implemented in accordance with the present invention.

FIG. 2 illustrates an exemplary disposable cryosurgical sheath 202 and an exemplary TCM applicator 212 implemented in accordance with the present invention. The disposable sheath 202 is shown for purposes of explaining the invention. The sheath 202 includes a tip 204, cannula cover 206 and main body 208. The tip 204 may be made out of a thermally conductive material, e.g., copper, while the cannula cover 206 and main body 208 may be made of a flexible insulating material, e.g., a latex material. For purposes of applying TCM to inside portions of the sheath 202, the sheath is placed onto the applicator 212 by moving it in the direction indicated by arrow 210.

The Applicator 212 comprises a tubular applicator tip 214, tubular applicator shaft 220 and main housing 224. The tubular design of the applicator tip 214 and applicator shaft 220 provides a hollow channel through the center of the shaft 220 and nozzle 214 through which TCM and/or air can pass.

The tubular applicator tip 214 has a closed tip end 213, an open shaft end 216 and a tubular nozzle portion 215 connecting the tip end and shaft end together. The closed tip end 213 may be mushroom shaped with radial edges protruding over the narrower tubular nozzle portion 215 to prevent application of TCM to the very end to the sheath's tip.

The shaft end 216 of the applicator tip 214 can be attached to the applicator shaft 220 by threads or other non-permanent attachment methods which allow for easy removal, cleaning and/or replacement of the applicator tip 214. Alternatively, the applicator tip 214 can be permanently attached to, and/or integrated with, the applicator shaft 220.

A plurality of nozzles 217 extend axially along the length of the tip's nozzle portion 215. Each nozzle 217 extends through the sidewall of the tip's nozzle portion into the hollow channel extending through the center of the tubular nozzle 215. Nozzles 217 may be implemented as holes in the tip 214. TCM entering the nozzles 217 by way of the tip's hollow channel will be expelled onto portions of the interior surface of the sheath 202. In various implementations nozzle holes having a diameter D in the range between and including 0.142" through 0.144" ($0.142" \leqq D \leqq 0.144"$) were found to be suitable. Nozzles outside the exemplary range may also be used.

When the sheath is placed onto the applicator 212 air can be trapped between the sheath 202 and 22 applicator shaft 220 and/or nozzle 214. In order to remove such air prior to TCM application, the tubular applicator shaft 220 may include an air bleeder hole 218. Air trapped at or near the tip of the sheath 202 during insertion onto the applicator 212 can pass through the nozzles 215 and out through the bleeder hole 218 by way of the hollow channel extending though the center of the applicator shaft and nozzle. Removing the air from the tip portion 214 of the sheath 202 in this manner prior to application of the TCM, facilitates proper positioning of the sheath on the applicator device 212.

The applicator housing 224 comprises a gear and motor assembly 234, a control module 226, and a TCM dispenser 236. The TCM dispenser includes a TCM storage container 240 which is coupled to a pump 238. When activated pump 238 pumps TCM from the storage container 240 into the shaft's channel and out through the tip's nozzles 217.

The applicator shaft 220 is mounted to the gear and motor assembly 234 which, when activated, causes the shaft 220 and tip 214 mounted thereon to rotate. The control module may include a contact switch 222 which protrudes through the top of the applicator housing 224, and a timing and control circuit 228. Alternatively, instead of a contact switch, a manually operated switch may be used as a start switch. In such an embodiment, an operator manually activates the start switch to begin the TCM application process. The timing and control circuit 228 controls the rotation of the applicator shaft 220 and thus tip 214 by way of a motor control signal supplied to the gear and motor assembly 234. It also controls application of TCM by enabling/disabling a TCM pump 238 included in the dispenser 238 by way of a pump control signal.

Contact switch 222 is activated as a result of contact with the sheath 202 when the sheath is properly placed over the applicator tip and shaft for TCM application. In response to activation of the switch 222, timing and control circuit 228 processed to control motor and pump operation to insure proper application of TCM as will be discussed further below with reference to FIG. 4.

Figure 3:
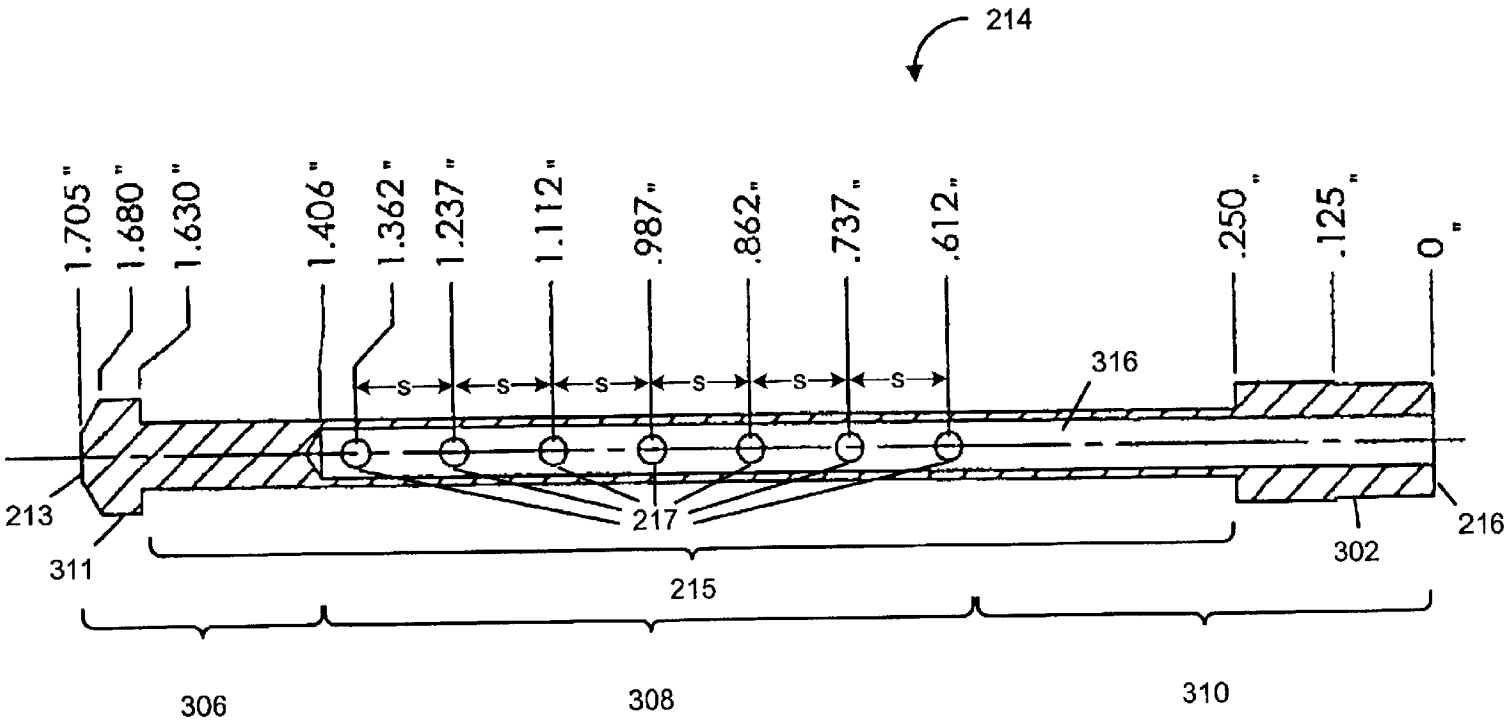
FIG. 3 is a diagram of an exemplary TCM applicator tip suitable for use with the TCM applicator illustrated in FIG. 2.

The design of the TCM applicator tip 214 will now be discussed further with regard to FIG. 3. FIG. 3 illustrates an exemplary tip 214 in detail. As illustrated, a solid mushroom shaped head 311 is position at the tip end 213 of the applicator tip 214. The mushroom shaped head 311 protrudes radially outward beyond the sidewall of the tubular nozzle portion 215 of the tip 214. Nozzles 217 are uniformly spaced in the axial direction of the tip 214 by a distance S, e.g., 0.125 inches apart. Nozzles 217 extend along a central portion of the tip's nozzle region 215. A base 302 is positioned at the shaft end 216 of the tip 302 for purposes of attachment to the shaft. As discussed above, the base 302 may be threaded so that it can be screwed to the shaft 220.

From a TCM application standpoint, the applicatior tip 214 can be divided into three regions or portions, an upper solid tip region 306, a TCM application region 308 corresponding to the area where nozzles 217 are located, and a lower tip region 310.

Notably, as a result of the applicator tip's design, application of TCM to the inside tip of the sheath may be avoided. During use, as a probe is inserted into the sheath, a small amount of TCM will be scraped from the sidewall of the sheath and forced up into the tip. Accordingly, by carefully controlling the application of TCM to the sheath's sidewall with the understanding that some of the TCM will be transferred to the inside of the sheath's tip during use, a high degree of uniformity can be achieved in TCM coating while avoiding lumps and/or other insertion problems.

Figure 4:
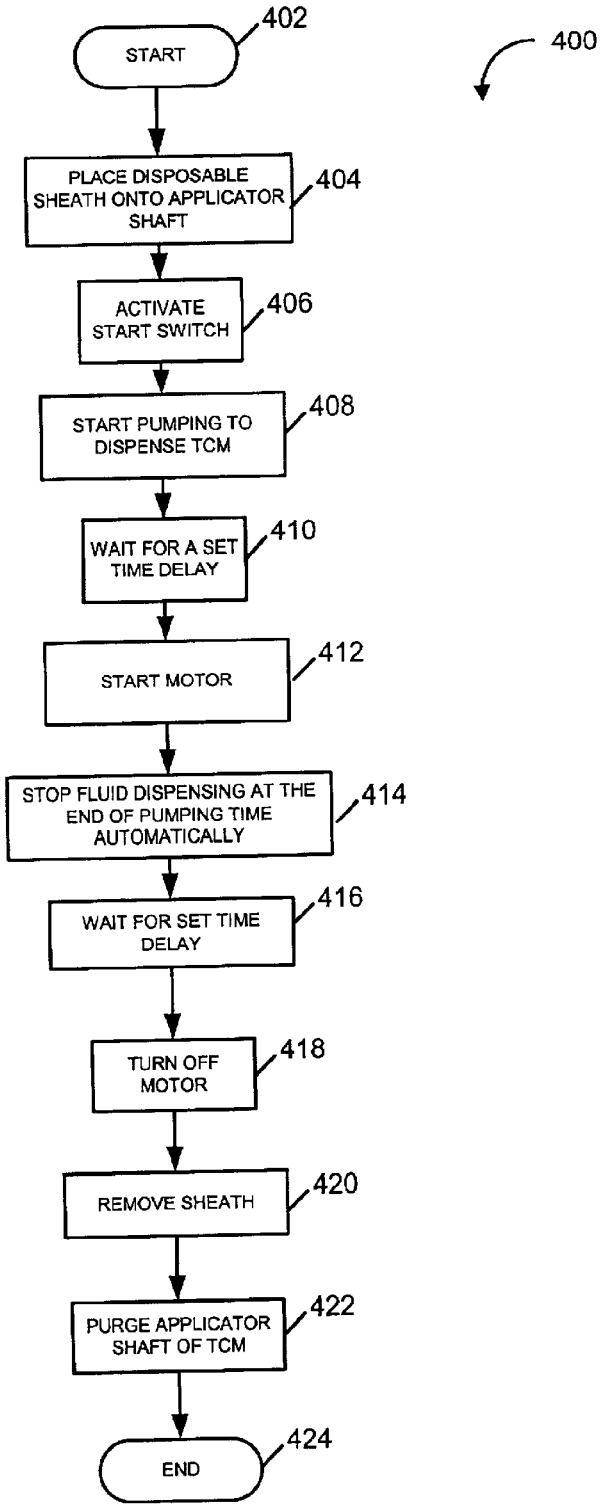
FIG. 4 is a flow chart illustrating the steps of a TCM application method of the present invention.

FIG. 4 illustrates an exemplary method 400 for applying TCM to an inside portion of a disposable sheath in accordance with the present invention. The method starts in step 402 with a sheath being selected for TCM application. Then in step 404 the selected sheath is placed over the applicator tip 214 and shaft 220. As the sheath is placed over the shaft 220 it will come into contact with contact switch 222. In response to the start switch 222 being activated, in step 408, the timing and control circuit 228 turns the TCM dispenser pump on. This causes TCM to start traveling up the applicator shaft 220 due to the pumping action. Then, in step 412 the motor 234 is turned on. An optional waiting period, shown as step 410, may be inserted between the time pumping action is started and motor 234 is turned on. Such a waiting period can be useful, e.g., in embodiments where the shaft 220 and applicator tip 214 are purged after each use.

Activation of the motor 234 causes the applicator tip 214 and shaft 220 to rotate as TCM is pushed out the nozzles 217. After a set period of time, in step 414, the timing and control circuit 228 shuts off the pump 238. Then, in step 416, the control circuit waits for another set period of time before proceeding to step 418 wherein the motor 234 is turned off. Once the motor is turned off, the sheath is removed in step 420.

In optional step 422 the timing and control circuit 228 activates the pump to purge the applicator shaft of TCM. This can be done by, e.g., operating the pump 238 to create a vacuum in the shaft 220 to suck out the remaining TCM. After the shaft is purged, the TCM application process stops in step 424 leaving the applicator 212 ready for the next sheath to be processed.

By initiating motor operation after TCM dispensing begins, the risk of damaging the sheath from the rotating action of the applicator tip and shaft is reduced. In addition, by continuing to rotate the applicator tip and shaft after TCM pumping has been stopped serves to distribute the TCM applied near the tip through the wiping action of the rotating tip and applicator shaft.

In one particular exemplary embodiment a specific amount of TCM, e.g., 0.040–0.045 grams, was applied around the inside of the conductive region of disposable sheath 202 to form a thin layer, e.g., 0.0030 inches deep and having a high degree of uniformity.

In the above described manner, the applicator 212 of the present invention can be used to spread TCM on the inner circumference of the conductive region of a disposable sheath evenly, and quickly with far greater accuracy then the known manual application technique. In addition, application of TCM to the tip of the sheath can be avoided and/or minimized allowing the application to occur during probe insertion.

Ten experimental applications were preformed using 80 psi of pressure to pump the TCM, and a 0.143 diameter tip. During the tests, the applicator dispensed an average of 0.040 grams of TCM during a 12 second application period, with the range of application amounts being between 0.037–0.043 grams. The resulting thickness of applied TCM to the interior of the sheath at the intended locations varied from a minimum of 0.0022" to a maximum of 0.0040". The slight variance between applications during testing shows a high degree of repeatability which is important from a quality control standpoint. Furthermore, using the TCM applicator of the invention produced TCM coatings which were, in most cases, considerably thinner and more uniform than could be achieved using the known manual application technique.

The automated TCM application process described above has the advantage of providing a uniform TCM coating, avoiding lumps, and insuring that TCM application is limited to intended portions of a sheath.

Numerous variations on the above described methods and apparatus are possible without departing from the scope of the invention. For example, application and removal of sheaths to/from the described TCM applicator device 212 can, and in one embodiment is, automated using a robotic device.

What is claimed is:

1. An apparatus for applying a thermal conductive medium to an inside portion of a sheath having a closed end portion, the apparatus comprising:

a tubular applicator tip including a plurality of nozzles positioned in a sidewall of the tubular applicator tip;

a pump having an input adapted for coupling to a source of thermal conductive medium and an output coupled to said tubular applicator tip;

a control module for controlling the pump and thereby the amount of thermal conductive medium applied to said sheath by the tubular applicator tip; and an applicator shaft for coupling the tubular applicator tip to the pump output;

wherein the tubular applicator tip has a closed tip end preventing expulsion of thermal conductive medium from the tip in the axial direction of said tip;

wherein said tubular applicator tip includes an open shaft end attached to said applicator shaft, and wherein said plurality of nozzles are located along a line extending in the axial direction between said closed tip end and said open end.

2. The apparatus of claim 1, further comprising:

a contact switch coupled to the control circuit, the contact switch being positioned to come into contact with the sheath when the sheath is properly positioned over the tubular applicator tip.

3. An apparatus for applying a thermal conductive medium to an inside portion of a sheath, the apparatus comprising:

a tubular applicator tip including a nozzle positioned in a sidewall of the tubular applicator tip;

a pump having an input adapted for coupling to a source of thermal conductive medium and an output coupled to said tubular applicator tip;

a control module for controlling the pump and thereby the amount of thermal conductive medium applied to said sheath by the tubular applicator tip;

wherein the tubular applicator tip has a closed tip end preventing expulsion of thermal conductive medium from the tip in the axial direction of said tip;

a contact switch coupled to the control circuit, the contact switch being positioned to come into contact with the sheath when the sheath is properly positioned over the tubular applicator tip;

an applicator shaft for coupling the tubular applicator tip to the pump output;

wherein the nozzle has a diameter in the range extending from and including 0.14" to and including 0.145"; and wherein the applicator shaft includes a bleeder hole having a diameter one third or less the diameter of said nozzle.

4. An apparatus for applying a thermal conductive medium to an inside portion of a sheath, the apparatus comprising:

a tubular applicator tip including a nozzle positioned in a sidewall of the tubular applicator tip;

a pump having an input adapted for coupling to a source of thermal conductive medium and an output coupled to said tubular applicator tip;

a control module for controlling the pump and thereby the amount of thermal conductive medium applied to said sheath by the tubular applicator tip;

wherein the tubular applicator tip has a closed tip end preventing expulsion of thermal conductive medium from the tip in the axial direction of said tip;

a contact switch coupled to the control circuit, the contact switch being positioned to come into contact with the sheath when the sheath is properly positioned over the tubular applicator tip;

an applicator shaft for coupling the tubular applicator tip to the pump output; and a motor, for rotating said shaft, coupled to said applicator shaft and to said control module.

5. The apparatus of claim 4, wherein the control module includes:

a timing circuit for activating said pump in response to activation of said contact switch and for activating said motor following activation of said pump.

6. The apparatus of claim 5, wherein the timing circuit includes:

means for deactivating said pump after a set period of time; and deactivating said motor after deactivation of said pump.

7. An apparatus for applying a thermal conductive medium to an inside portion of a sheath, the apparatus comprising:

a tubular applicator tip including a nozzle positioned in a sidewall of the tubular applicator tip;

a pump having an input adapted for coupling to a source of thermal conductive medium and an output coupled to said tubular applicator tip;

a control module for controlling the pump and thereby the amount of thermal conductive medium applied to said sheath by the tubular applicator tip;

wherein the tubular applicator tip has a closed tip end preventing expulsion of thermal conductive medium from the tip in the axial direction of said tip;

wherein said tubular applicator tip includes:

an open shaft end attached to said applicator shaft, a plurality of nozzles located along a line extending in the axial direction between said closed tip end and said open end;

wherein the tubular applicator tip further comprises:

a mushroom shaped cap portion at the closed tip end; and wherein each of said plurality of nozzles is a hole in the sidewall of said tubular applicator tip.

8. A system for applying a thermal conductive medium to a portion of the interior of a sheath, the system comprising:

a thermal conductive medium storage device;

a pump coupled to the thermal conductive medium storage device;

a thermal conductive medium applicator tip comprising a first end coupled to said pump and including at least one hole spaced from a second end of said thermal conductive medium applicator tip through which thermal conductive medium can be expelled when pumped through the applicator tip by said pump, wherein said first end is spaced from said second end along a length of said thermal conductive medium applicator tip; and a switch coupled to said pump, for controlling activation of said pump.

9. The system of claim 8, further comprising:

a hollow applicator shaft for mounting said thermal conductive medium applicator tip, the hollow applicator shaft coupling said thermal conductive medium applicator tip to the pump; and a motor connected to said hollow applicator shaft for causing said applicator shaft to rotate.

10. The system of claim 9, wherein said thermal conductive medium applicator tip is tubular in shape having a closed tip at the second end, an open shaft at the first end and a sidewall extending from the second end to the first end, said hole being located in the sidewall.

11. The system of claim 10, further comprising:

a control circuit for coupling said switch to said pump and said motor, the control circuit including means for activating said pump in response to activation of said switch.

12. The system of claim 8, wherein said switch is a contact switch, the switch being positioned to come into contact with the sheath when the sheath is positioned over said thermal conductive medium applicator tip.

* * * * *